US006763218B2

(12) United States Patent
Hamada et al.

(10) Patent No.: US 6,763,218 B2
(45) Date of Patent: Jul. 13, 2004

(54) FIXING APPARATUS

(75) Inventors: Yasuhide Hamada, Tokyo (JP); Yuichiro Higashi, Tokyo (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/218,459

(22) Filed: Aug. 15, 2002

(65) Prior Publication Data

US 2003/0039492 A1 Feb. 27, 2003

(51) Int. Cl.[7] ..... G03G 15/20
(52) U.S. Cl. ..... 399/329
(58) Field of Search ..... 399/320, 328, 399/329, 122; 219/216

(56) References Cited

U.S. PATENT DOCUMENTS 5,621,512 A * 4/1997 Uehara et al. ..... 399/328
5,826,141 A * 10/1998 Mitsuya ..... 399/122
6,137,984 A * 10/2000 Higashi et al. ..... 399/329
6,330,419 B1 * 12/2001 Sano et al. ..... 399/328 X

* cited by examiner

*Primary Examiner*—Hoan Tran
(74) *Attorney, Agent, or Firm*—Westerman, Hattori, Daniels & Adrian, LLP

(57) ABSTRACT

The present invention provides an improved fixing apparatus capable of reliably releasing a sheet having toner fixed thereon from a fixing belt without any releasing pawl even in large-sized sheets. The fixing apparatus includes a fixing roller, a pressing roller in rotational contact with the fixing roller, a biasing member for applying a biasing force to the pressing roller so as to bring the pressing roller into press contact with the fixing roller at a given pressure, a heating roller disposed apart from the fixing roller, a fixing belt wound around both the heating and fixing rollers in an endless manner, and a heat-generating device embedded in the heating roller to heat the fixing belt so as to heat unfixed toner on a sheet passing through a rotational contact region between the fixing and pressing rollers, whereby when the sheet having unfixed toner on a surface thereof is passed through the rotational contact region along one direction, the unfixed toner is fixed onto the sheet. In this fixing apparatus, an interior angle θ between an axis X and an axis Y is arranged to satisfy the following relationship, $$-30° < \theta < -80°$$

where X is an axis connecting the center of the fixing roller and the center of the pressing roller, and Y is an axis along a biasing direction in which the pressing roller applies the biasing force to the fixing roller in the rotational contact region, wherein on the basis of the axis X, a positive sign is provided to the angle θ when the axis Y is located on a sheet-feed side where the sheet is fed into the rotational contact region.

21 Claims, 9 Drawing Sheets

FIXING APPARATUS

FIELD OF THE INVENTION

The present invention relates to a fixing apparatus used in copiers, printers, facsimile machines or the like to thermo-compression-bond unfixed toner on a sheet and fix it onto the sheet.

BACKGROUND OF THE INVENTION

In late years, a technique as shown in FIG. 9 has been developed to a fixing apparatus for electrophotographic systems. In this technique, a belt type fixing apparatus comprises a fixing roller R1, a heating/tension roller (hereinafter referred to as "heating roller") R3, a fixing belt B wound around both the fixing and heating rollers, and a pressing roller R2 for pressing the fixing roller R1 upward through the fixing belt B. Further, the belt type fixing apparatus is combined with a preheating device of a recording medium D. According to this fixing apparatus, a nip region can be set at a lower temperature by virtue of the preheating of the recording medium D. This allows the heat capacity of the fixing belt B to be reduced. Thus, when passing through the nip region, the fixing belt B is quickly cooled down to provide accelerated aggregation of toner to be released from the fixing belt B at the outlet of the nip region, and consequently enhanced releasability between the fixing belt B and the toner, so that a clear fixed toner image will be obtained without undesirable offset even if no oil or a small amount of oil is applied. This fixing apparatus is known as an effective solution of technical problems in releasability and oil application which have not been solved by a heating roller system.

The structure of the above conventional belt type fixing apparatus will be briefly described bellow. The fixing apparatus comprises the fixing roller R1, the pressing roller R2 disposed below the fixing roller R1, the heating roller R3 disposed on the side of the fixing roller R1 (on the upstream side along the feeding direction of the recording medium), and the fixing belt B wound around both the fixing roller R1 and the heating roller R3.

An oil coating roller R4 is provided above an upper belt run of the fixing belt B. Further, a guide plate G serving as a support member for the recording medium is provided below an lower belt run of the fixing belt B with leaving a certain distance therebetween to define a heating passage P for heating the recording medium between the lower belt run of the fixing belt B and the upper surface of the guide plate B. A pressing lever U is adapted to press the heating roller R3 in the direction causing the heating roller R3 to get away from the fixing roller R1 so as to provide a desired tension of the fixing belt B, and the heating roller R3 is driven by the fixing roller R1, so that the fixing belt B can be stably rotated without slipping or sagging.

The belt type fixing apparatus has various features as described above. On the other hand, the belt type fixing apparatus exposes extremely deteriorated releasability as a sheet is large-sized, particularly when used in an electrophotographic machine compatible with A-3 size sheets (or A4 cross-feed), and it transpires that a desired releasability is hardly secured without a separation pawl. Thus, there is a need for improving such a disadvantage.

SUMMARY OF THE INVENTION

In view of the above circumstances, it is therefore an object of the present invention to provide a fixing apparatus capable of reliably releasing a sheet having fixed toner thereon from a fixing belt without any separation pawl even if the sheet is large-sized.

It is another object of the invention to provide a fixing apparatus capable of reliably releasing a sheet having fixed toner thereon from a fixing belt even in an electrophotographic machine compatible with A-3 size sheets.

In order to achieve the above objects, according to a first aspect of the present invention, there is provided a fixing apparatus comprising: a fixing roller; a pressing roller in rotational contact with the fixing roller; a biasing member for applying a biasing force to the pressing roller so as to bring the pressing roller into press contact with the fixing roller at a given pressure; a heating roller disposed apart from the fixing roller; a fixing belt wound around both the heating and fixing rollers in an endless manner; and a heat-generating device embedded in the heating roller to heat the fixing belt so as to heat unfixed toner on a sheet passing through a rotational contact region between the fixing and pressing rollers, whereby when the sheet having unfixed toner on a surface thereof is passed through the rotational contact region along one direction, the unfixed toner is fixed onto the sheet. In this fixing apparatus, an interior angle θ between an axis X and an axis Y is arranged to satisfy the following relationship, $$-30° < \theta < -80°$$

where X is an axis connecting the center of the fixing roller and the center of the pressing roller, and Y is an axis along a biasing direction in which the pressing roller applies the biasing force to the fixing roller in the rotational contact region, wherein on the basis of the axis X, a positive sign is provided to the angle θ when the axis Y is located on a sheet-feed side where the sheet is fed into the rotational contact region, and a negative sign is provided to the angle θ when the axis Y is located on a sheet-discharge side where the sheet is discharged from the rotational contact region.

According to a second aspect of the present invention, there is provided a fixing apparatus comprising: a fixing roller; a pressing roller in rotational contact with the fixing roller; a biasing member for applying a biasing force to the pressing roller so as to bring the pressing roller into press contact with the fixing roller at a given pressure; a heating roller disposed apart from the fixing roller; a fixing belt wound around both the heating and fixing rollers in an endless manner; and a heat-generating device embedded in the heating roller to heat the fixing belt so as to heat unfixed toner on a sheet passing through a rotational contact region between the fixing and pressing rollers, whereby when the sheet having unfixed toner on a surface thereof is passed through the rotational contact region along one direction, the unfixed toner is fixed onto the sheet. In this fixing apparatus, the pressing roller is rotatably pivoted to a swingable member swingably supported on a given pivot shaft, the biasing member being coupled with the swingable member to allow the pressing roller to be brought into press contact with the fixing roller, and an interior angle θ between an axis X and an axis Y being arranged to satisfy the following relationship, $$-30° < \theta < -80°$$

where X is an axis connecting the center of the fixing roller and the center of the pressing roller, and Y is an axis along a direction perpendicular to a straight line which passes through the rotational contact region and connects the pivot shaft and the rotational contact region, wherein on the basis of the axis X, a positive sign is provided to the angle θ when the axis Y is located on a sheet-feed side where the sheet is fed into the rotational contact region, and a negative sign is provided to the angle θ when the axis Y is located on a sheet-discharge side where the sheet is discharged from the rotational contact region.

According to a third aspect of the present invention, there is provided a fixing apparatus comprising: a fixing roller; a pressing roller in rotational contact with the fixing roller; and a biasing member for applying a biasing force to the pressing roller so as to bring the pressing roller into press contact with the fixing roller at a given pressure, whereby when a sheet having unfixed toner on a surface thereof is passed through a rotational contact region between the fixing and pressing rollers along one direction, the unfixed toner is fixed onto the sheet. In this fixing apparatus, the fixing roller is disposed to be opposed to the surface of the sheet having unfixed toner, the pressing roller being disposed on the opposite side of the pressing roller to allow the sheet to be nipped therebetween, and the rotational contact region having an inlet region for receiving the sheet therein and an outlet region for discharging the sheet therefrom, wherein the pressing roller is arranged to provide a pressure distribution in the rotational contact region along the feeding direction of the sheet in which a pressure at the outlet region is higher than that at the inlet region.

In the fixing apparatus according to the first or second aspect of the present invention, the angle θ may be arranged to satisfy the following relationship.

$$-40^\circ < \theta < -55^\circ$$

In the fixing apparatus according to the first or second aspect of the present invention, the heating roller may be disposed on the opposite side of the pressing roller on the basis of a feeding path of the sheet interposed therebetween. Further, the fixing roller and the pressing roller may be disposed vertically apart from one another, and the heating roller may be disposed above the fixing roller.

In the fixing apparatus according to the first or second aspect of the present invention, the pressing roller may be disposed on the opposite side of the fixing roller on the basis of a feeding path of the sheet interposed therebetween. Further, the pressing roller may be disposed with a displacement in the discharging direction of the sheet from a position symmetrically opposite to the fixing roller on the basis of the feeding path.

In the fixing apparatus according to the second aspect of the present invention, the pivot shaft may be disposed with a displacement in the discharging direction of the sheet greater than that of the center of the pressing roller.

In the fixing apparatus according to the first, second or third aspect of the present invention, the fixing belt includes an endless-shaped substrate made of metal. Further, the endless-shaped substrate may be made of electroformed nickel.

Alternatively, the fixing belt may include an endless-shaped substrate made of synthetic resin. Further, the endless-shaped substrate may be made of polyimide.

DESCRIPTION OF THE PREFERRED EMBODIMENT

With reference to the drawings, the structure of a fixing apparatus according to embodiments of the invention will now be described in detail.

General Description of Fixing Apparatus 10

Figure 1:
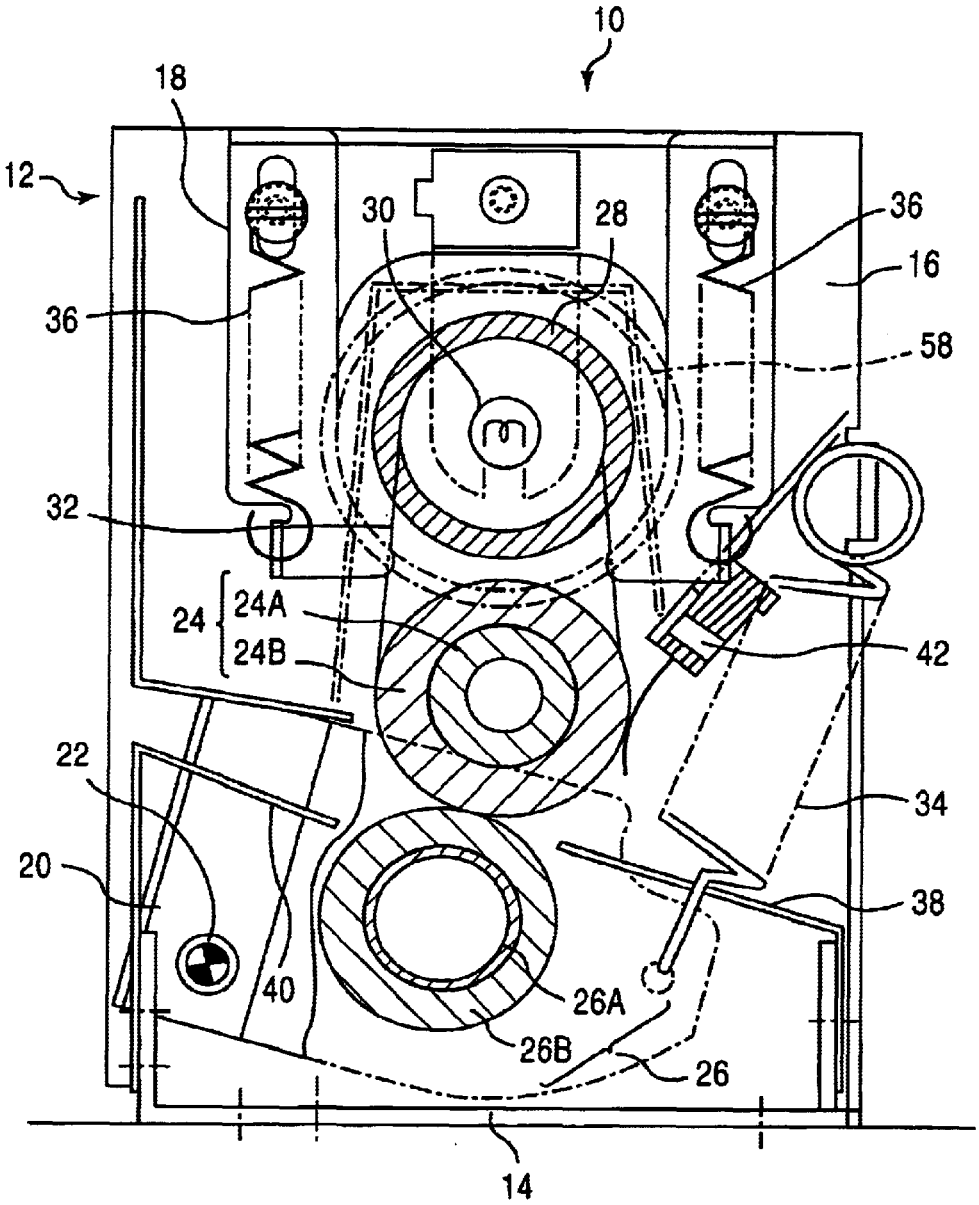
FIG. 1 is a sectional front view showing the structure of a fixing apparatus according to a first embodiment of the invention.

As shown in FIG. 1, a fixing apparatus 10 according to a first embodiment includes a housing 12 as a housing structure to be fixed to a frame of electronic image forming equipment (not shown) such as an electronic printer. The housing 12 comprises a base plate 14 to be fixed directly to the frame of the equipment, and a pair of side plates 16 standing from the front and rear side edges of the base plate 14, respectively. In FIG. 1 being a front view, an unfixed sheet, or a sheet having unfixed toner on the upper surface thereof, is fed from right hand to left hand through a feeding mechanism (not shown), as described in detail later.

In the upper portion of the housing 12, a slidable bracket 18 is attached to both the side plates 16 in a slidable manner along the vertical direction in the figure, and a heating roller 28 (described later) is rotatably pivoted to the slidable bracket 18. In the lower portion of the housing 12, a swingable bracket 20 is supported by both the side plates 16 through a pivot shaft 22 in a swingable manner about the pivot shaft 22, and a pressing roller 26 (described later) is rotatably pivoted to the swingable bracket 20.

As a roller structure, the fixing apparatus 10 includes: a fixing roller 24 pivoted to both the side plates 16 rotatably about a fixed axis; a pressing roller 26 which is disposed approximately below the fixing roller 24 (specifically, obliquely leftward downward in the figure) to be in rotational contact with the fixing roller 24 and is supported by the swingable bracket 20 rotatably about a fixed axis arranged in parallel with the fixed axis of the fixing roller 24; and a heating roller 28 which is disposed approximately above the fixing roller 24 and is rotatably supported by the slidable bracket 18.

The fixing apparatus 10 further includes a heat source such as a halogen lamp provided inside the heating roller 28, and a fixing belt (heat transfer belt) 32 wound around both the fixing roller 24 and the heating roller 28 in an endless manner.

The fixing roller 24 is comprised of a resilient roller, while the pressing roller 26 is comprised of a roller having a higher hardness on the roller than that of the resilient roller, as described in detail later. A first coil spring 34 applies a biasing force to the swingable bracket 20 to rotate the swingable bracket 20 about the pivot shaft 22 in a direction for allowing the pressing roller 26 to be brought into press contact with the fixing roller 24. As a result, the fixing roller 24 and the pressing roller 26 are in rotational contact with one another at a given contact pressure in a rotational contact region (nip region) therebetween. This allows the fixing roller 24 to be dented in the rotational contact region, which provides a sufficient nip width.

The fixing apparatus 10 further includes a second coil springs 36 disposed between each of the right and left ends of the slidable bracket 18 and the corresponding side plate 16 to bias the heating roller 28 in a direction causing the heating roller 28 to get away from the fixing roller 24 so as to provide a given tension to the fixing belt 32. Two pairs of the second coil springs 36 are provided on the front and rear sides of the right end and on the front and rear sides of the left end, respectively.

The housing 12 is also provided with a feed guide plate 38 for guiding an unfixed sheet toward the rotational contact region and a discharge guide plate 40 for discharging a fixed sheet, or a sheet which has passed through the rotational contact region and completed the fixing operation, toward a discharge port. Further, the housing 12 is provided with a thermister 42 for detecting a surface temperature in a region of the fixing roller 24 which is not wound by the fixing belt 32 and located on the immediate upstream side of the rotational contact region with respect to the rotational direction of the fixing roller 24. The thermister 42 employed in the first embodiment is a contact type operable to detect a surface temperature of an object by contacting the surface of the object.

The temperature detect position for the thermister 42 is not limited to the aforementioned peripheral surface of the fixing roller 24 which is not wound by the fixing belt 32, and the thermister 42 may be attached to detect a temperature in the peripheral surface of the fixing belt 32 which is wound around the periphery of the fixing roller 24 and located on the immediate upstream side of the rotational contact region with respect to the rotational direction of the fixing roller. In this case, the thermister 42 is preferably a non-contact type.

The leading end of the unfixed sheet supplied to the fixing apparatus 10 through the feeding mechanism 10 (not shown) is first brought into contact with the upper surface of the feed guide plate 38 and then fed obliquely upward with being guided by the feed guide plate 38. The leading end of the unfixed sheet guided by the feed guide plate 38 is brought into contact with the peripheral surface of the pressing roller 26, and then moved along the peripheral surface of the pressing roller 26 to enter into the rotational contact region between the fixing roller 24 and the pressing roller 26.

In the fixing apparatus 10 schematically constructed as described above, the unfixed sheet S is fed on the feed guide plate 38 through the feeding mechanism (not shown), and the back surface of the unfixed sheet S having no unfixed toner thereon is supported by the feed guide plate 38. Further, the unfixed sheet S is guided toward the rotational contact region (nip region) between the fixing roller 24 wound by the fixing belt 32 and the pressing roller 26. When the unfixed sheet S is compressedly passed through between the fixing roller 24 and the pressing roller 26, the unfixed toner will be thermo-compression-bonded on the sheet and fixed onto the sheet.

The above various structural elements will be individually described below.

Description of Fixing Roller 24

The fixing roller 24 comprises a core 24A rotatably pivoted on the side plate 16 through a bearing 44 (see FIG. 2), and a roller body 24B disposed on the periphery of the core 24A coaxially therewith and wound by the fixing belt 32. In the first embodiment, the fixing roller 24 is arranged to have an outside diameter of 25.0 mm. In this embodiment, the core 24A is formed of an iron shaft having a diameter of 15 mm, and the roller body 24B is formed of a silicone rubber heat-resistant resilient material (specifically, ASKER C hardness of 23 degree on the roller) having a thickness of 5 mm which is attached to the peripheral of the core 24A.

Figure 2:
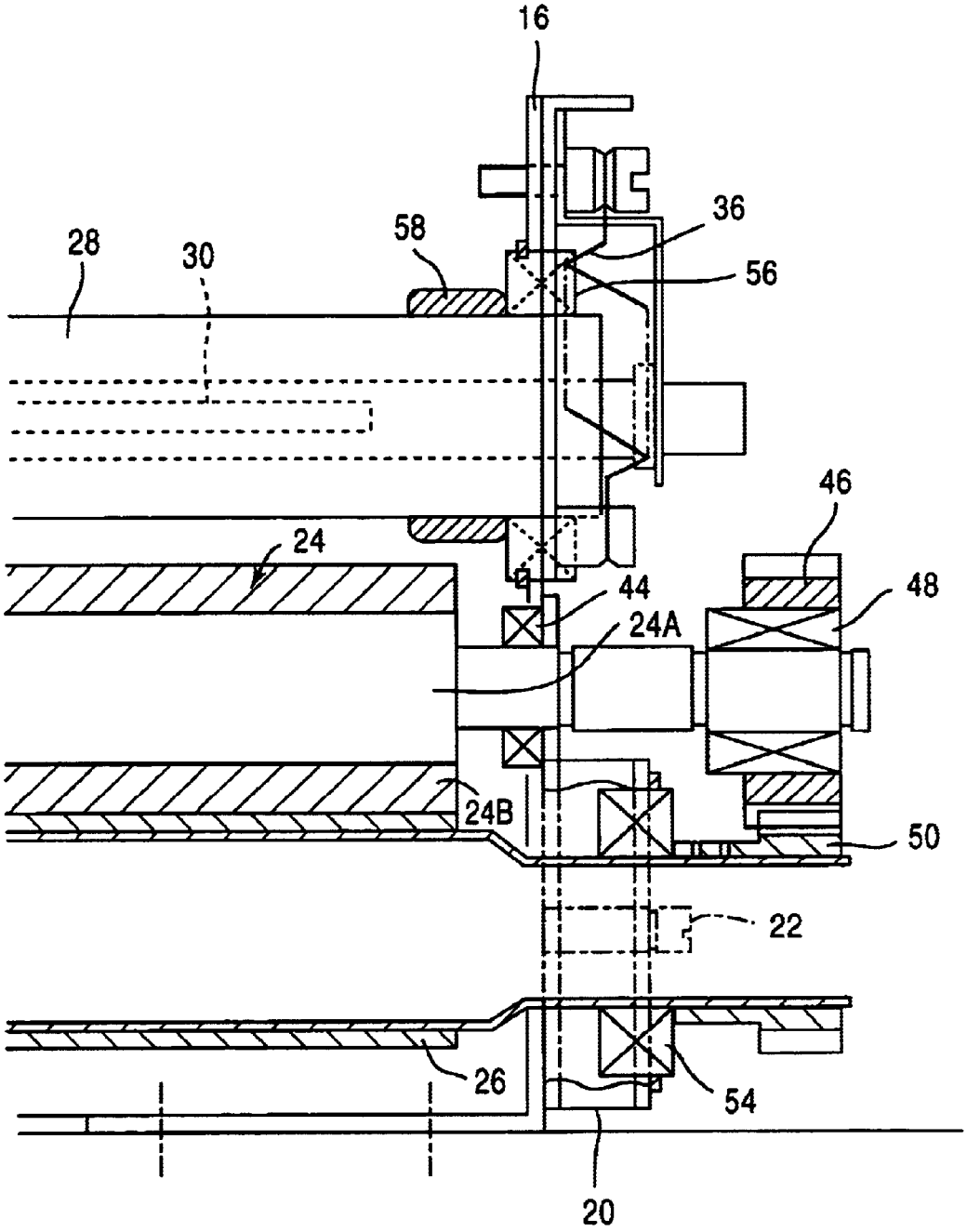
FIG. 2 is a sectional view showing the structure at the respective support ends of rollers in the fixing apparatus shown in FIG. 1.

As shown in FIG. 2, a first driven gear 46 is attached coaxially to a shaft provided at one of the ends of the core 24A through a one-way clutch 48 (described in detail later). The first driven gear 46 is engaged with a second driven gear 50 coaxially attached to one of the ends of a core 26A (described later) of the pressing roller 26. The second driven gear 50 is engaged with a drive gear (not shown) constituting a part of a driving mechanism 52. In this way, a driving force from the driving mechanism 52 is transmitted to the second driven gear 50 through the drive gear as a turning force counterclockwise in FIG. 1. Then, the counterclockwise turning force is transmitted to the first driven gear 46 as a turning force clockwise in FIG. 1, and the clockwise turning force is transmitted to the fixing roller 24 through the one-way clutch 48.

Description of One-Way Clutch 48

In the first embodiment, the one-way clutch 48 is operable to allow the fixing roller 24 to be rotated relative to the first driven gear 46 clockwise in the figure, but to prevent the fixing roller 24 from being rotated relative to the first driven gear 46 counterclockwise in the figure or to allow the fixing roller to be rotated integrally with the first driven gear 46. That is, in the state when the fixing belt 32 is frictionally engaged with the pressing roller 26 and the fixing roller 24 is frictionally engaged with the fixing belt 32 to allow the fixing roller 24 and the fixing belt 32 to be driven (or dragged) by the pressing roller 26, the peripheral speed of the fixing roller 24 rotated clockwise in the figure is arranged to be equal to that of the pressing roller 26, and the rotational speed of the fixing roller 24 is arranged to be slightly higher than that of the driven gear 46.

Description of Pressing Roller 26

As described above, the pressing roller 26 comprises the core 26A rotatably pivoted on the side plate 16 through a bearing 54, and a roller body 26B disposed on the periphery of the core 26A coaxially therewith. The pressing roller 26 is arranged to have an outer diameter of 24 mm. In the first embodiment, the core 26A is formed of an iron pipe having an outside diameter of 21 mm and a wall thickness of 2 mm, and the roller body 26B is formed of a silicone rubber heat-resistant resilient material (specifically, having an ASKER C hardness of 74–75 degree on a roller harder than the fixing roller 24) having a thickness of 1.5 mm which is attached to the periphery of the core 26A.

As described above, the second driven gear 50 is fixed coaxially to the shaft provided at the one end of the core 26A, and the first driven gear 46 is engaged with the second driven gear 50. A driving force from the driving gear (not shown) is directly transmitted to the second driven gear 50 to allow the pressing roller 26 to be rotatably driven counterclockwise in the opposite direction of the fixing roller 24.

In the first embodiment, the pressing roller 26 is selected as a primary driving source for feeding the unfixed sheet. Thus, a gear ratio between the first and second driven gear 46, 50 is arranged such that the fixing roller 24 can keep its peripheral speed less than that of the pressing roller 26 even if the fixing roller 24 is thermally expanded. More specifically, the rotational speed as the fixing roller 24 is rotated by the driven gear 46 is arranged to be slightly lower than that as the fixing roller 24 is rotated by frictionally engaging with the pressing roller 26 through the fixing belt 32.

In the first embodiment, the pressing roller 26 is not disposed directly below the fixing roller 24, but with a certain displacement from the position directly below the fixing roller 24 to the downstream side along the feeding direction of the unfixed sheet. Specifically, given that a line segment passing through both centers of the heating roller 28 and the fixing roller 24 is defined as a base line, an interior angle between the base line and a line segment passing through both the centers of the fixing roller 24 and the pressing roller 26 is arranged to be a given acute angle. The line segment passing through both the centers of the fixing roller 24 and the pressing roller 26 is arranged to be substantially perpendicular to the feeding direction of the unfixed sheet.

Description of Heating Roller 28

In the first embodiment, the heating roller 28 housing a first heat source 30 comprises a core which is formed of an iron pipe having a diameter of 18 mm and a wall thickness of 0.1 mm, and a PTFE (polytetrafluoroethylene) covering layer which covers over the peripheral surface of the core and has a thickness of 20 μm. That is, for the purpose of shortening a warm-up time, the core of heating roller 28 is thinned, as described later. Each of both ends of the heating roller 28 is rotatably pivoted through a bearing 56, and a collar made of heat-resistant poly-ether-ether-ketone (PEEK) is inserted into each of the bearings 56 to prevent the fixing belt from being tortured or displaced during its running in endless manner.

The first heat source 30 serving as a heat-generating device is embedded in the heating roller 28. In the first embodiment, the first heat source 30 is comprised of a halogen lamp having a maximum output of 800W.

Description of Fixing Belt 32

Preferably, the fixing belt 32 has a heat capacity per square cm ranging from 0.002 cal/° C. to 0.025 cal/° C. to allow the unfixed toner on the unfixed sheet S to be heated up to a fixing temperature and fixed onto the sheet without applying an excessive amount of heat.

Figure 3:
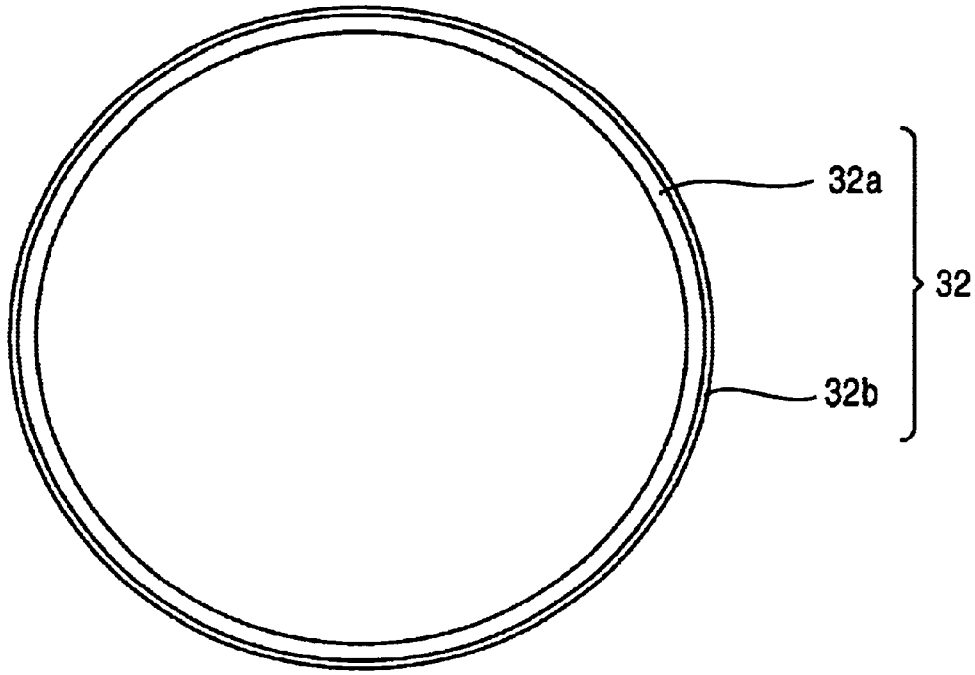
FIG. 3 is a front view showing the structure of a fixing belt.

From this point of view, as shown in FIG. 3, the fixing belt 32 in the first embodiment includes an endless-shaped belt substrate 32*a* made of polyimide resin having an inside diameter of 40 mm and a thickness of 70 μm, and a PFA heat-resistant releasing layer 32*b* which covers the peripheral surface (surface layer) of the belt substrate 32*a* and has a thickness of 30 μm. For providing improved quality of a fixed image, the peripheral surface of the belt base 32*a* may be coated directly with a resilient layer made of silicon rubber layer having a thickness of 300 μm. In this case, the PFA heat-resistant releasing layer 32*b* will be coated over the peripheral surface of the resilient layer.

In the present invention, it is to be understood that the material of the belt substrate 32*a* is not limited to polyimide resin and a metal belt made of electroformed nickel may be used. When the metal belt made of electroformed nickel is used as the belt substrate 32*a*, the belt base 32*a* having a thickness of 40 μm may be used, and the surface of the belt substrate may be coated with silicon rubber having a thickness of 300 μm. Further, as with the polyimide-resin belt substrate, the periphery of the heat-resistant silicon rubber layer may be covered with the PFA heat-resistant releasing layer 32*b* having a thickness of 300 μm.

Description of Tension Adjusting Mechanism for Fixing Belt 32

As described above, a tension adjusting mechanism for the fixing belt 32 in the first embodiment is comprised of the second coil spring 36 for biasing the heating roller 28 in a direction causing the heating roller 28 to get away from the fixing roller 24.

More specifically, the second coil spring 36 applies a biasing force to the heating roller 28 to allow the heating roller 28 to be displaced through the slidable bracket 18 in a direction causing the heating roller 28 to get away from the fixing roller 24. Thus, the fixing belt 32 wound around both the heating roller 28 and the fixing roller 24 in an endless manner will be stretched with a given tension.

Based on the action of the second coil spring 36, the fixing belt 32 is frictionally engaged with and dragged by the pressing roller 26. Further, in response to the dragging of the fixing belt 32, the fixing roller 24 is stably driven by the pressing roller 26 without slipping or sagging with respect to the fixing belt 32.

Description of Biasing Force Applying Mechanism for Pressing Roller 26

As described above with reference to FIG. 1, the pressing roller 26 is rotatably attached to the swingable bracket 20 swingably pivoted on the pivot shaft 22, and the first coil spring 34 is adapted to apply a biasing force to the swingable bracket 20 in a direction for allowing the pressing roller 26 to be brought into press contact with the fixing roller 24. As a result, the pressing roller 26 will be biased along a direction which passes through the rotational contact region where the pressing roller 26 is in rotational contact with the fixing roller 24 and intersects perpendicularly to a line segment connecting the rotational contact region and the pivot shaft 22.

Figure 5:
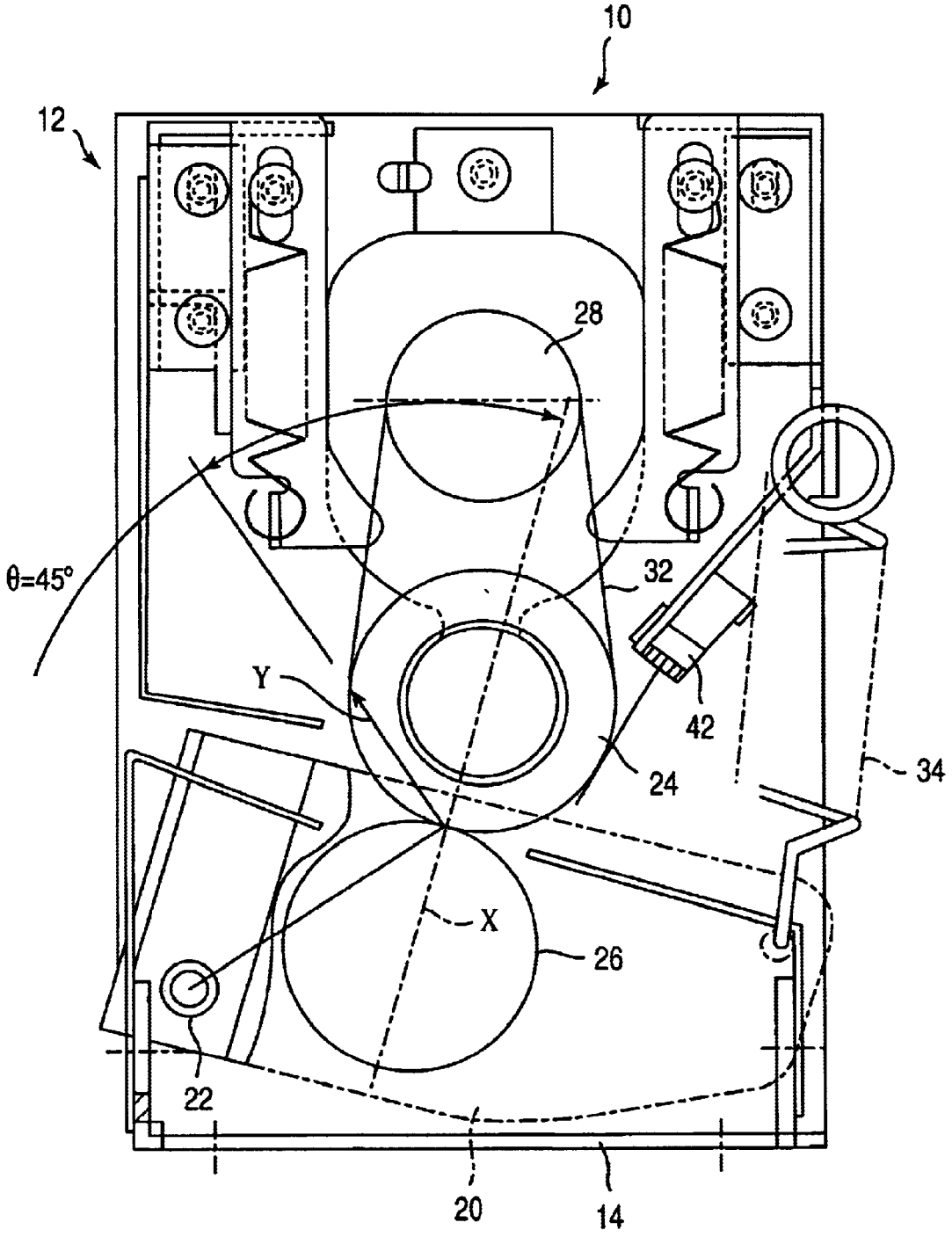
FIG. 5 is an explanatory view of the definition of an angle θ.

In the first embodiment, as shown in FIG. 5, given that X is an axis connecting the center of the fixing roller 24 and the center of pressing roller 26 and Y is an axis along a direction in which the pressing roller 26 applies a biasing force to the fixing roller 24 in the rotational contact region, an interior angle θ between the axis X and the axis Y is arranged to be −45 degrees (minus 45 degrees), wherein on the basis of the axis X, a positive sign is provided to the angle θ when the axis Y is located on a sheet-feed side where the sheet is fed into the rotational contact region, and a negative sign is provided to the angle θ when the axis Y is located on a sheet-discharge side where the sheet is discharged from the rotational contact region.

As a result, comparing with the state when the pressing roller 26 is in rotational contact with the fixing roller 24 symmetrically with respect to the feeding direction of the unfixed sheet (that is, said angle θ is zero degree), the pressing roller 26 in the first embodiment will be in rotational contact with the fixing roller 24, with a certain displacement (deflection) in the discharging direction of the unfixed sheet. Thus, when microscopically observing the press contact state (pressure distribution) between the pressing roller 26 and the fixing roller 24 in the rotational contact region, the discharge side of the rotational contact region will have a higher pressure than that of the feed side of the rotational contact region.

In this manner, the press-contact direction of the pressing roller 26 to the fixing roller 24 is deflected toward the discharge side of the unfixed sheet to provide a higher pressure of the discharging side than that of the feed side in the rotational contact region. This allows the releasability to be significantly improved, and the fixed sheet is reliably released from the fixing belt 32 wound around the fixing roller 24, without any releasing pawl.

An optimal range of the angle θ will be described in detail later.

Construction of Controlling Unit

Figure 4:
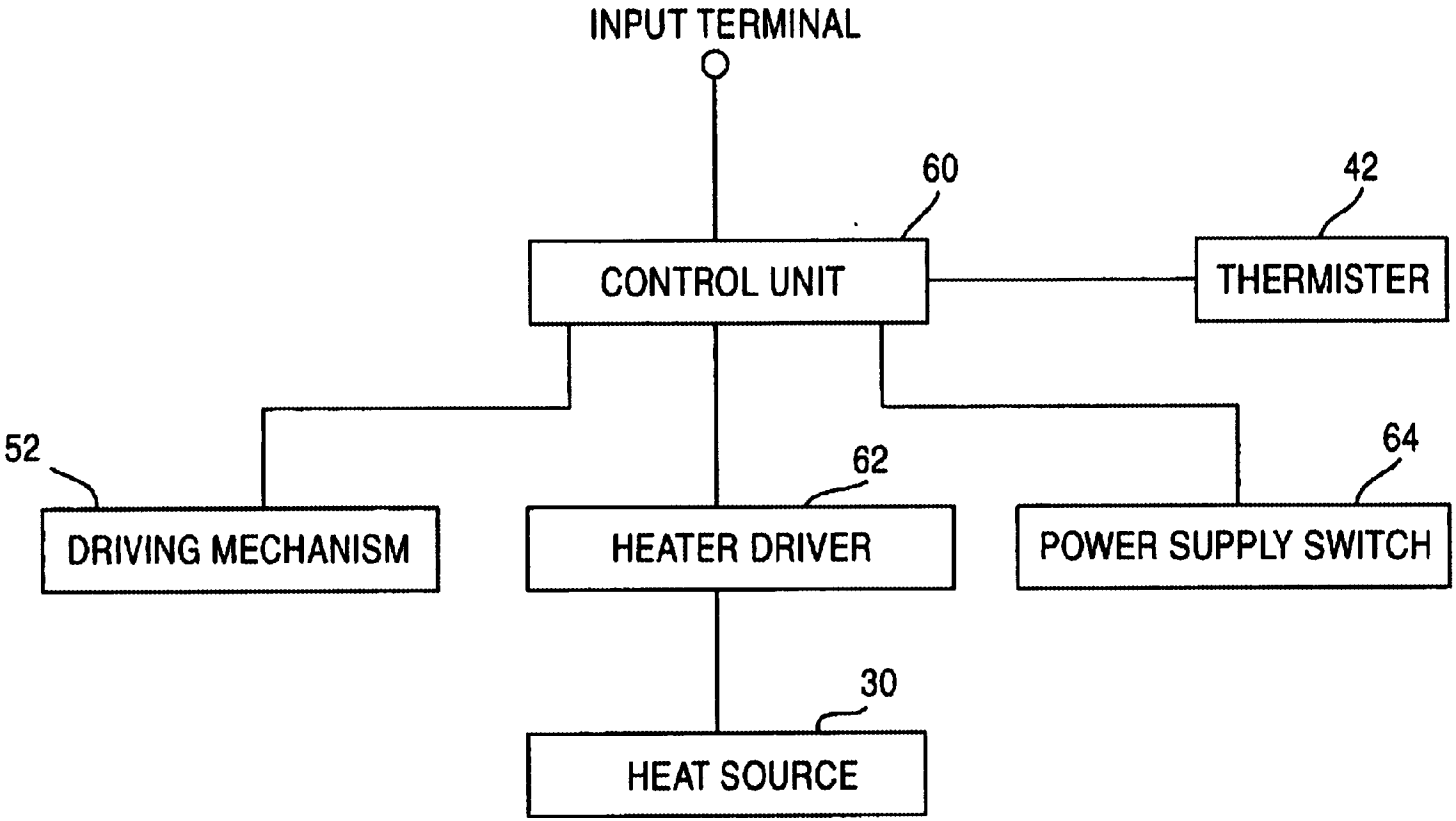
FIG. 4 is a schematic block diagram showing a control unit.

As shown in FIG. 4, the fixing apparatus 10 includes a control unit 60 to control the heat generation of heat source 30 embedded in the heating roller 28 as well as the aforementioned drive control of the driving mechanism 52. In order to control the heat generation of the heat source 30 (specifically, heat generation control during a fixing belt simultaneous start control), the single thermister 42 is connected to the control unit 60 as described above, and the heat generation of heat source 30 is controlled only by a detect signal from the thermister 42.

In view of the heat generation control, a heater driver 62 is connected to the control unit 60, and a halogen lamp serving as the heat source 30 is controlled through the heater driver 62. Further, in view of a running control of the fixing belt 32, the control unit 60 is provided with an input terminal for receiving a sheet feeding command (printing start signal) from a printer control unit (not shown), and an output terminal for outputting a printing allowable signal to the printer control unit. A power supply switch 64 is also connected to the control unit 60.

Description of Heat Generation Control Process According to Control Unit 60

A heat-generation control process (control steps) in the heat source 30 according to the control unit 60 will be described below.

Only if the following two conditions are satisfied, the control unit is arranged to energize the heat source 30 and turn on the halogen lamp to generate heat.

(1) when a ready state between an output of a printing start signal or a fixing operation start signal from a printer control unit (not shown) governing an entire control of an electronic printer (not shown) and the detection of a fixing available temperature by the thermister 42 is established; and (2) after the thermister 42 detects the fixing available temperature to output the printing allowable signal to the printer control unit, when a fixing operation state between the start of a printing operation at the printer control unit in response to the printing allowable signal and an output of a printing terminating signal is established.

When a waiting state between an output of the print terminating signal and an output of a subsequent printing start signal is established, the control unit 60 is operable to bring the heat source 30 into a halt state so as to prevent any heat generation operation.

In this manner, the control unit 60 executes no heat generating operation through the heat source 30 in a printing waiting state, or the waiting state, and thereby an energy saving effect will be reliably achieved.

In the first embodiment, when the power supply switch 64 is turned on, the printer control unit is operable to output the printing start signal unconditionally. Thus, when an operator turns on the power supply switch 64, a printing available state will be quickly achieved.

In the waiting state, the surface temperature of the heating roller 28 is lowered down to room temperature level because the heat source 30 is not operated at all. However, the heating roller 28 is formed in a thin wall having a thickness of 0.1 mm as described above. Thus, when the above condition (1) or the ready state is established and the heating roller 28 is heated up from room temperature, the heat from the heat source 30 is transferred to the peripheral surface of the heating roller 28 in a short time. This provides significantly reduced warm-up period for the peripheral surface of the heating roller 28 to reach a given target fixing temperature.

A warm-up period is given by a sum of a time t1 between the activation of the heat source 30 and the achievement of the given target fixing temperature at the peripheral surface of the heating roller 28, and a time t2 required for the achievement of the given target fixing temperature at the rotational contact region in conjunction with the running of the fixing belt 32 heated by the peripheral surface of the heating roller 28. In the state when the endless-shaped fixing belt 32 starts running in synchronous with the activation of the heat source 30 as described later, the time t1 was about 6 seconds, and the time t2 was about 9 seconds. Even in the warm-up state of the heating roller 28 from a room temperature under the condition (1), the warm-up period is about 15 seconds. This value can easily come up to the standard of 30 seconds which is set as a target of an allowable warm-up period for operators described in articles or the like. Thus, the warm-up period in the first embodiment will achieve an effect of reliably maintaining excellent operation performance without frustration of operators.

Description of Control Process of Driving Mechanism 52 According to Control Unit 60

A control process of the driving mechanism 52 according to the control unit 60 will be described below.

In the state when the condition (1) is established, the control unit 60 in the first embodiment is operable to activate a driving motor (not shown) in synchronous with the activation of the heating device 30 so as to activate and rotate the first and the second driven gear 46, 50. In conjunction with this rotation, the fixing belt 32 is run in an endless manner.

It is to be understood that in the state when the condition (2) is established, the control unit 60 is arranged to run the fixing belt 32 in an endless manner as in the condition (1), because the fixing operation of the unfixed sheet is performed when the condition (2) is established.

The driving mechanism 52 in the control unit 60 may control the fixing belt 32 to run in synchronism with the activation of the heat source 30 as described above. Alternatively, the driving mechanism 52 may control the fixing belt 32 to run at a lower running speed (a first running speed) than a given running speed (a second running speed) in the fixing operation for a given period after the activation of the heat source 30, and, after the given period, to run at the given running speed for fixation. By initially running the fixing belt 32 at the lower speed, the warm-up period can be further shortened.

The switching timing of the running speed of the fixing belt 32 is not limited to the timing of the given elapsed time. For example, the same effect can be obtained by using the timing when the thermister 42 detects a target temperature arranged lower than the given fixing available temperature.

Further, the above lower running speed (the first running speed) does not include zero speed. However, it is to be understood that the first running speed can be set at zero. In this case, until the timing of switching the speed, the heat source 30 is activated, but the running of the fixing belt 32 is suspended. By activating the fixing belt 32 in retard of the activation of the heat source 30, the warm-up period can be further shortened.

Verification of Optimum Range of Angle θ

An optimum range of the angle θ will be verified.

Figure 6:
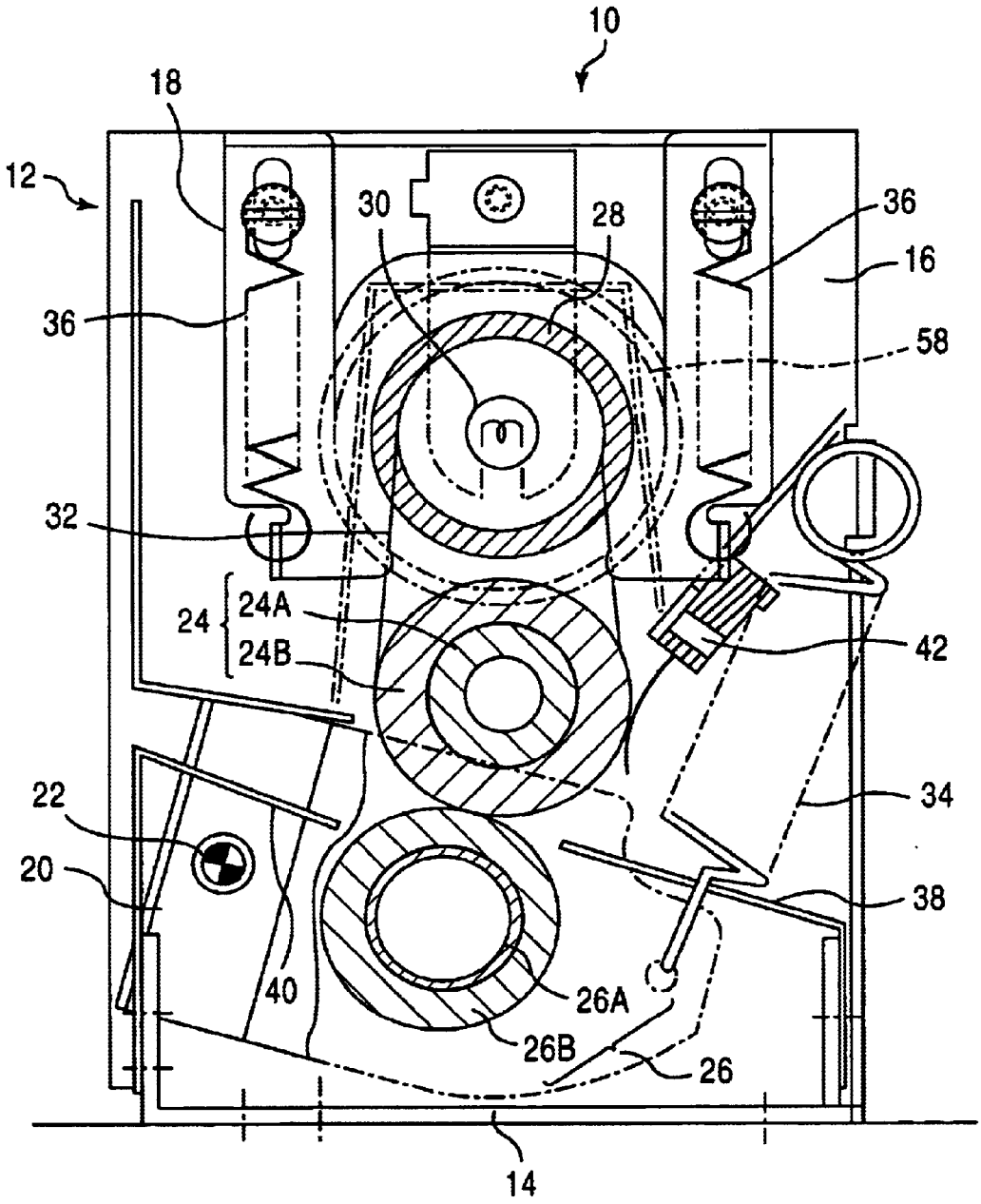
FIG. 6 is a sectional front view showing one modification of the structure shown in FIG. 1, in which the value of the angle θ is different from that in the structure of FIG. 1.
Figure 7:
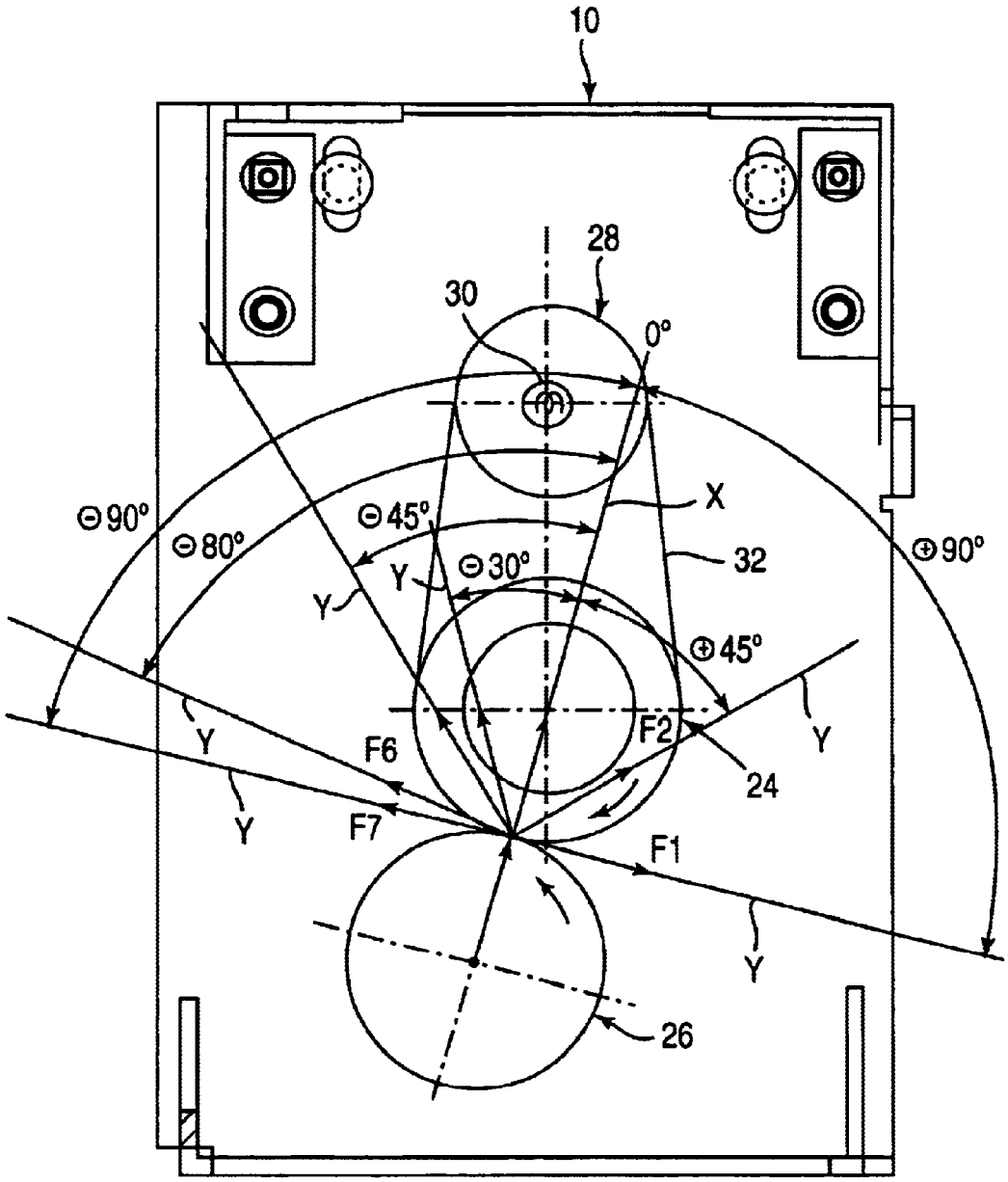
FIG. 7 is an explanatory view of various examples in which the angles θ is varied.

For this verification, for example, the angle θ was variously set in range of +90 degrees to −90 degrees by changing the position of the pivot shaft 22 as shown in FIG. 6. Specifically, as an example 1, the angle θ was set at +90 degrees and a sheet releasability in this structure was determined. A biasing direction of the pressing roller 26 (or a direction along axis Y) in the example 1 is represented by the mark F1, and the biasing direction of the pressing roller 26 in an example X is represented by the mark FX. The definition of the positive/negative signs (+/−) added to the angle is the same as described above.

For an example 2,the angle θ was set at +45 degrees, and for an example 3,the angle θ was set at zero degree (or the state when the pressing roller 26 is in rotational contact with the fixing roller 24 in alignment with one another without any displacement and deflection). For an example 4, the angle θ was set at −30 degrees, and for an example 5, the angle θ was set at −45 degrees (the structure of the first embodiment). For an example 6, the angle θ was set at −80 degrees, and for an example 7, the angle θ was set at −90 degrees. In each example, a sheet releasability was determined using three paper sizes (A4 size longitudinal feed /4 colors solid, A4 size cross feed/single color solid, A4 size longitudinal feed/4 colors solid) as a parameter.

The results are shown in the following Table 1, wherein the mark "○" indicates that no troubles were occurred in the sheet releasability, the mark "Δ" indicates that some troubles were occurred in the sheet releasability, but the trouble could be solved by adjusting the guide or other measures, and the mark "X" indicates that trouble was occurred in the sheet releasability and the trouble could not be solved by any measures.

For common determining conditions in each example, the surface temperature of the fixing belt 32 was controlled to fall within 140° C.–160° C. Further, 64 g/square mm plain paper was used as a sheet, and the sheet was fed at a linear speed of 125 mm/second. C620 toner of Xerox Corporation was used as toner for forming a solid image.

In a comprehensive evaluation, an example having at least one of "X" was defined as the comprehensive evaluation of "X", an example having at least one of "Δ" was defined as the comprehensive evaluation of "Δ", and an example having "○" for everything was defined as the comprehensive evaluation of "○". These were put together in Table 1.

TABLE 1

| condition of pressurization | | condition on nip forming | | releasability w/o pawl | | | |
|---|---|---|---|---|---|---|---|
| | | | | A4 longitudinal | A4 cross | A4 cross | |
| | angle | | | 4 colors | single | 4 colors | comprehensive |
| mark | (degree) | status | evaluation | solid | color solid | solid | evaluation |
| F1 | +90 | nip NG | X | X | — | — | X |
| F2 | +45 | nip formed | ○ | ○ | X | X | X |
| F3 | 0 | nip formed | ○ | ○ | Δ | X | X |
| F4 | −30 | nip formed | ○ | ○ | ○ | Δ | Δ |
| F5 | −45 | nip formed | ○ | ○ | ○ | ○ | ○ |
| F6 | −80 | compression of 0.5 mm | Δ | ○ | ○ | ○ | Δ |
| F7 | −90 | nip NG | X | — | — | — | X |

As is apparent from the Table 1, it was proved that an allowable range capable of obtaining the general estimation of "Δ" or "○" was in the range of −30 degrees to −80 degrees, and an optimal range capable of obtaining the general estimation "○" was in the range of −40 degrees to −55 degrees.

The angle θ of the first embodiment is set at −45 degrees which falls within both the allowable range and the optimal range.

As described above in detail, according to the invention, given that a positive sign is provided to the interior angle θ between the axis X and the axis Y when the biasing axis (Y) of the pressing roller 26 to the fixing roller 24 lies in the sheet feed side on the basis of the axis (X) connecting the centers of the fixing roller 24 and the pressing roller 26, the pressing roller 26 will be in rotational contact with the fixing roller 24, with a certain displacement (deflection) on the discharge side of the unfixed sheet by arranging the angle θ in the range of −30° C. to −80° C., compared to the state when the pressing roller 26 is in rotational contact with the fixing roller without any displacement (deflection) or the state when the angle θ has a positive sign. Thus, when microscopically observing the press contact state (pressure distribution) between the pressing roller 26 and the fixing roller 24 in the rotational contact region, the discharge side of the rotational contact region will have a higher pressure than that of the feed side of the rotational contact region.

Thus, by setting the angle θ in said range, the press-contact direction of the pressing roller 26 to the fixing roller 24 is deflected toward the discharge side of the unfixed sheet to provide a higher pressure of the discharging side than that of the feed side in the rotational contact region. This allows the releasability to be significantly improved, and the fixed sheet is reliably released from the fixing belt 32 wound around the fixing roller 24, without any releasing pawl.

In addition, by defining the range of angle θ to press the fixing roller on a slant, a broader nip width can be advantageously formed by a lower pressure as compared to the conventional apparatus.

It should be understood that the present invention is not limited to the construction of the above embodiment, and various modifications can be made without departing from the spirit and scope of the present invention.

For example, while an oil-applying roller for applying releasing oil on the peripheral surface of the fixing belt 32 has not been described in the above embodiment, the invention is not limited to the construction without such an oil-applying roller, and any suitable oil-applying roller may be incorporated into the construction of the present invention. In this case, the oil-applying roller will be in press contact with the fixing roller 32 at a given pressure. Thus, the oil-applying roller can be used as the tension adjusting device in cooperation with the second coil spring 36 or as a substitute for the second coil spring 36.

Further, while the core 28*a* of the heating roller 28 has been made of an iron pipe in the above embodiment, the invention is not limited to this construction, and a pipe made of aluminum or stainless steel such as SUS may be used to form the core 28*a*.

Further, while the first embodiment has described only the heat source 30 serving as the heat-generating device embedded in the heating roller 28, the invention is not limited to such a construction, and any suitable second heat source may be additionally embedded in the heating roller 28. In this case, the second heat source may be comprised, for example, of a 250W halogen lamp having a lower maximum output than the heat source 30 embedded in the heating roller 28.

It is to be understood that a sheet or film-shaped heater may be used as the heat source 30, as a substitute for the halogen lamp. That is, any suitable type or shape of heat-generating device may be unlimitedly used.

Further, the present invention is not limited to the belt type fixing apparatus, and the present invention may be applied, for example, to a conventional two-roller type fixing apparatus.

In the first embodiment, the swingable bracket 20 rotatably supporting the pressing roller 26 is swingably provided on the pivot shaft 22, and the first coil spring 34 applies a biasing force to the swingable bracket 20 in the direction of the fixing roller 24 to allow the pressing roller 26 to be brought in press contact with the fixing roller 24. Further, the direction of the biasing force of the first coil spring 34 is independent of (i.e. different from) the biasing direction of the pressing roller 26. However, the invention is not limited to this construction. For example, as in a second embodiment shown in FIG. 8, the direction of the biasing force of the first coil spring 34 may be matched with the biasing direction (moving direction) of the pressing roller 26.

Figure 8:
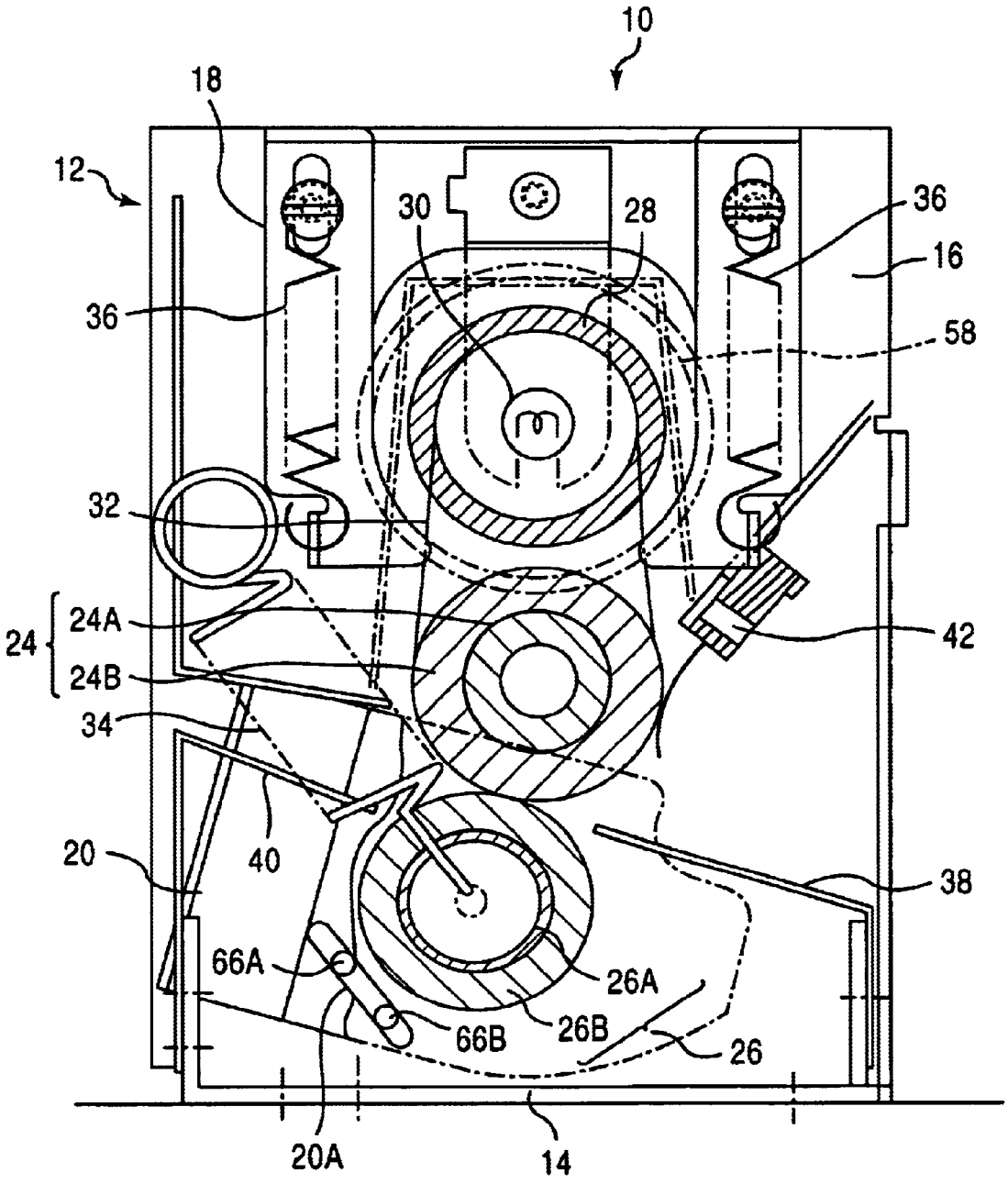
FIG. 8 is a sectional front view showing the structure of a second embodiment according to the invention.
Figure 9:
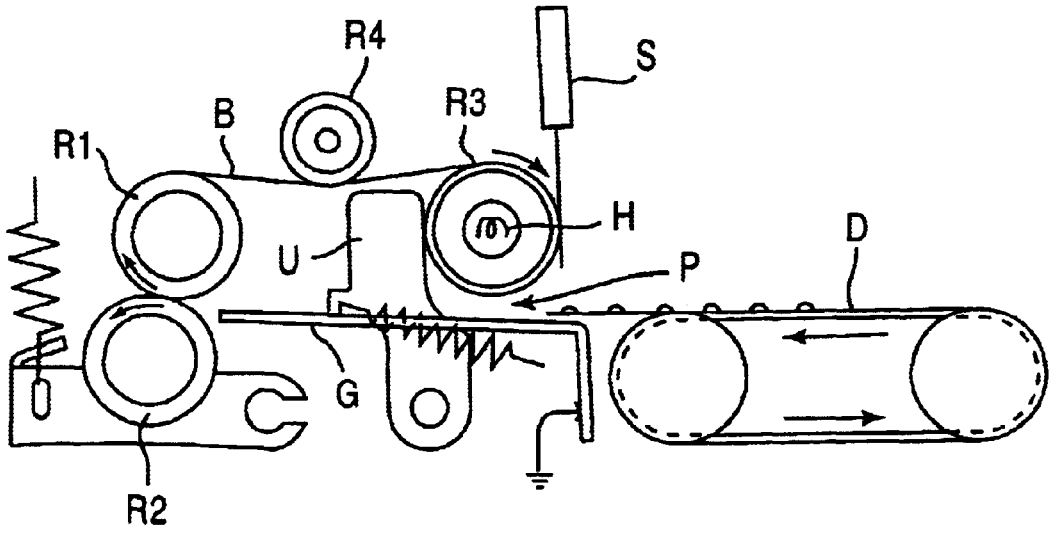
Fig. 9 Prior Art
FIG. 9 is a schematic diagram showing the structure of a conventional belt type fixing apparatus.

With reference to FIG. 8, the construction of the second embodiment of the invention will be described below. In FIG. 8, the same components or elements as those in the above embodiment are defined by the same reference numerals, and their description will be omitted.

In the second embodiment shown in FIG. 8, a swingable bracket 20 is formed with an elongated hole 20A extending in a given direction, and a pair of guide pins 66A, 66B are slidably inserted into the elongated hole 20A. While not shown in detail, each of the guide pins 66A, 66B is fixedly provided in the side plate 16. Thus, the swingable bracket 20 will be regulated to move along the longitudinal direction of the elongated hole 20A.

In the second embodiment, the direction for regulating the movement of the swingable bracket 20 is arranged to allow the angle θ to be about 45 degrees.

Further, in the second embodiment, the biasing direction of the first coil spring 34 is arranged to match with the longitudinal direction of the elongated hole 20A or the moving direction of the swingable bracket (That is, the axis Y along the biasing direction of the pressing roller 26 attached to the swingable bracket 20).

Thus, in the second embodiment, the biasing force of the first coil spring 34 acts directly as the biasing force of the pressing roller 26, and thereby a higher biasing force will be obtained, as compared to the first embodiment in which when the biasing direction of the first coil spring 34 is different from the biasing axis of the pressing roller 26, one component force vector-resolved from the biasing force of the first coil spring 34 acts as the biasing force of the pressing roller. In other words, based on the same acting force or pressure, the second embodiment shown FIG. 8 can employ a coil spring having a smaller spring pressure than the first coil spring in the first embodiment.

As described above, the present invention can provide a fixing apparatus capable of arranging the pressure distribution in the rotational contact region along the sheet feeding direction such that the inlet or feed side has a lower pressure than that of the outlet or discharge side by setting the angle θ within the given range. This allows the fixed sheet to be reliably released from the fixing belt without any releasing pawl even in large-sized sheets.

Further, the present invention can provide a fixing apparatus capable of arranging the pressure distribution in the rotational contact region along the sheet feeding direction such that the inlet or feed side has a lower pressure than that of the outlet or discharge side by setting the angle θ within the given range. This allows the fixed sheet to be reliably released from the fixing belt without any releasing pawl even in an electrophotographic machine compatible with A-3 size sheets.

What is claimed is:

1. A fixing apparatus comprising:

a fixing roller;

a pressing roller in rotational contact with said fixing roller;

a biasing member for applying a biasing force to said pressing roller so as to bring said pressing roller into press contact with said fixing roller at a given pressure;

a heating roller disposed apart from said fixing roller;

a fixing belt wound around both said heating and fixing rollers in an endless manner; and a heat-generating device embedded in said heating roller to heat said fixing belt so as to heat unfixed toner on a sheet passing through a rotational contact region between said fixing and pressing rollers, whereby when the sheet having unfixed toner on a surface thereof is passed through said rotational contact region along one direction, said unfixed toner is fixed onto said sheet, wherein an interior angle θ between an axis X and an axis Y is arranged to satisfy the following relationship, $$-30^\circ < \theta < -80^\circ$$

where X is an axis connecting the center of said fixing roller and the center of said pressing roller, and Y is an axis along a biasing direction in which said pressing roller applies the biasing force to said fixing roller in said rotational contact region, wherein on the basis of said axis X, a positive sign is provided to said angle θ when said axis Y is located on a sheet-feed side where the sheet is fed into said rotational contact region, and a negative sign is provided to said angle θ when said axis Y is located on a sheet-discharge side where the sheet is discharged from said rotational contact region.

2. A fixing apparatus as defined in claim 1, wherein said angle θ is arranged to satisfy the following relationship.

$$-40° < \theta < -55°$$

3. A fixing apparatus as defined in claim 1, wherein said heating roller is disposed on the opposite side of said pressing roller on the basis of a feeding path of the sheet interposed therebetween.

4. A fixing apparatus as defined in claim 3, wherein said fixing roller and said pressing roller are disposed vertically apart from one another, and said heating roller is disposed above said fixing roller.

5. A fixing apparatus as defined in claim 1, wherein said pressing roller is disposed on the opposite side of said fixing roller on the basis of a feeding path of the sheet interposed therebetween.

6. A fixing apparatus as defined in claim 5, wherein said pressing roller is disposed with a displacement in the discharging direction of the sheet from a position symmetrically opposite to said fixing roller on the basis of said feeding path.

7. A fixing apparatus as defined in claim 1, wherein said fixing belt includes an endless-shaped substrate made of metal.

8. A fixing apparatus as defined in claim 7, wherein said endless-shaped substrate is made of electroformed nickel.

9. A fixing apparatus as defined in claim 1, wherein said fixing belt includes an endless-shaped substrate made of synthetic resin.

10. A fixing apparatus as defined in claim 9, wherein said endless-shaped substrate is made of polymiide.

11. A fixing apparatus comprising:

a fixing roller;

a pressing roller in rotational contact with said fixing roller;

a biasing member for applying a biasing force to said pressing roller so as to bring said pressing roller into press contact with said fixing roller at a given pressure;

a heating roller disposed apart from said fixing roller;

a fixing belt wound around both said heating and fixing rollers in an endless manner; and a heat-generating device embedded in said heating roller to heat said fixing belt so as to heat unfixed toner on a sheet passing through a rotational contact region between said fixing and pressing rollers, whereby when the sheet having unfixed toner on a surface thereof is passed through said rotational contact region along one direction, said unfixed toner is fixed onto said sheet, wherein said pressing roller is rotatably pivoted to a swingable member swingably supported on a given pivot shaft, said biasing member is coupled with said swingable member to allow said pressing roller to be brought into press contact with said fixing roller, and an interior angle θ between an axis X and an axis Y is arranged to satisfy the following relationship, $$-30° < \theta < -80°$$

where X is an axis connecting the center of said fixing roller and the center of said pressing roller, and Y is an axis along a direction perpendicular to a straight line which passes through said rotational contact region and connects said pivot shaft and said rotational contact region, wherein on the basis of said axis X, a positive sign is provided to said angle θ when said axis Y is located on a sheet-feed side where the sheet is fed into said rotational contact region, and a negative sign is provided to said angle θ when said axis Y is located on a sheet-discharge side where the sheet is discharged from said rotational contact region.

12. A fixing apparatus as defined in claim 11, wherein said angle θ is arranged to satisfy the following relationship.

$$-40° < \theta < -55°$$

13. A fixing apparatus as defined in claim 12, wherein said fixing roller and said pressing roller are disposed vertically apart from one another, and said heating roller is disposed above said fixing roller.

14. A fixing apparatus as defined in claim 11, wherein said pressing roller is disposed on the opposite side of said fixing roller on the basis of a feeding path of the sheet interposed therebetween.

15. A fixing apparatus as defined in claim 14, wherein said pressing roller is disposed with a displacement in the discharging direction of the sheet from a position symmetrically opposite to said fixing roller on the basis of said feeding path.

16. A fixing apparatus as defined in claim 11, wherein said pivot shaft is disposed with a displacement in the discharging direction of the sheet greater than that of said center of said pressing roller.

17. A fixing apparatus as defined in claim 11, wherein said fixing belt includes an endless-shaped substrate made of metal.

18. A fixing apparatus as defined in claim 17, wherein said endless-shaped substrate is made of electroformed nickel.

19. A fixing apparatus as defined in claim 11, wherein said fixing belt includes an endless-shaped substrate made of synthetic resin.

20. A fixing apparatus as defined in claim 19, wherein said endless-shaped substrate is made of polyimide.

21. A fixing apparatus comprising:

a fixing roller;

a pressing roller in rotational contact with said fixing roller; and a biasing member for applying a biasing force to said pressing roller so as to bring said pressing roller into press contact with said fixing roller at a given pressure, whereby when a sheet having unfixed toner on a surface thereof is passed through a rotational contact region between said fixing and pressing rollers along one direction, said unfixed toner is fixed onto said sheet, wherein said fixing roller is disposed to be opposed to the surface of the sheet having unfixed toner, said pressing roller is disposed on the opposite side of said fixing roller to allow the sheet to be nipped therebetween, and said rotational contact region has an inlet region for receiving the sheet therein and an outlet region for discharging the sheet therefrom, wherein said pressing roller is arranged to provide a pressure distribution in said rotational contact region along the feeding direction of the sheet in which a pressure at said outlet region is higher than that at the inlet region.

* * * * *